US009326656B2

(12) United States Patent
Rieger et al.

(10) Patent No.: US 9,326,656 B2
(45) Date of Patent: May 3, 2016

(54) DISHWASHER HAVING TWO WATER CONNECTIONS AND CORRESPONDING CONTROL METHOD

(75) Inventors: Roland Rieger, Rainau (DE); Michael Georg Rosenbauer, Reimlingen (DE)

(73) Assignee: BSH Hausgeraete GmbH, Munich (DE)

( * ) Notice: Subject to any disclaimer, the term of this patent is extended or adjusted under 35 U.S.C. 154(b) by 749 days.

(21) Appl. No.: 13/322,926

(22) PCT Filed: Jun. 1, 2010

(86) PCT No.: PCT/EP2010/057570

§ 371 (c)(1),
(2), (4) Date: Nov. 29, 2011

(87) PCT Pub. No.: WO2010/142557

PCT Pub. Date: Dec. 16, 2010

(65) Prior Publication Data

US 2012/0073606 A1 Mar. 29, 2012

(30) Foreign Application Priority Data

Jun. 10, 2009 (DE) ..... 10 2009 026 887

(51) Int. Cl.
*A47L 15/00* (2006.01)
*A47L 15/42* (2006.01)

(52) U.S. Cl.
CPC ..... *A47L 15/0028* (2013.01); *A47L 15/0026* (2013.01); *A47L 15/0047* (2013.01); *A47L 15/4217* (2013.01); *A47L 15/0002* (2013.01); *A47L 2501/30* (2013.01)

(58) Field of Classification Search
None
See application file for complete search history.

(56) References Cited

U.S. PATENT DOCUMENTS

| | | | | |
|---|---|---|---|---|
| 4,070,204 | A * | 1/1978 | Hardy et al. | 134/25.2 |
| 4,356,812 | A * | 11/1982 | Haven | 126/572 |
| 8,734,590 | B2 * | 5/2014 | Jerg et al. | 134/25.2 |
| 2002/0040941 | A1 | 4/2002 | Wiemer et al. | |
| 2009/0038644 | A1 * | 2/2009 | Fauth et al. | 134/18 |

FOREIGN PATENT DOCUMENTS

| | | | |
|---|---|---|---|
| CH | 576091 | A5 | 5/1976 |
| DE | 2821427 | A1 | 11/1979 |
| DE | 3023355 | A1 | 1/1982 |
| DE | 10057263 | A1 | 5/2002 |

(Continued)

OTHER PUBLICATIONS

Machine translation of JP2002-291681 by Aoyanagi et al., published Oct. 8, 2002.*
Machine translation of JP2001-173044 by Kawarabayashi et al., published Jun. 26, 2001.*
International Search Report PCT/EP2010/057570.

*Primary Examiner* — Michael Kornakov
*Assistant Examiner* — Ryan Coleman
(74) *Attorney, Agent, or Firm* — James E. Howard; Andre Pallapies

(57) ABSTRACT

A dishwasher includes a water intake device having a hot water intake which receives hot water from an external hot water supply fed, at least partially, by a thermal solar system, and a cold water intake which receives cold water from an external cold water supply. A program control device stores at least one wash program for controlling a wash cycle for cleaning dishes. The at least one wash program has a program step for washing dishes using hot water from the hot water supply and another program step for washing dishes using cold water from the cold water supply.

24 Claims, 3 Drawing Sheets

(56) References Cited

FOREIGN PATENT DOCUMENTS

| | | | | |
|---|---|---|---|---|
| DE | 10226736 | A1 | | 1/2003 |
| DE | 20319404 | U1 | | 3/2005 |
| EP | 1362545 | A2 | | 11/2003 |
| EP | 1902658 | A1 | | 3/2008 |
| JP | 2001-173044 | | * | 6/2001 |
| JP | 2002-291681 | | * | 10/2002 |
| WO | 2006063895 | A1 | | 6/2006 |

* cited by examiner

DISHWASHER HAVING TWO WATER CONNECTIONS AND CORRESPONDING CONTROL METHOD

BACKGROUND OF THE INVENTION

The present invention relates to a dishwasher, in particular a domestic dishwasher, comprising a water intake device having a hot water intake and a cold water intake, the hot water intake being provided to receive hot water from an external hot water supply and the cold water intake being provided to receive cold water from an external cold water supply, and comprising a program control device in which at least one wash program for controlling a wash cycle for cleaning dishes is stored.

DE 100 46 347 A1 discloses a dishwasher comprising a water supply device including a cold water valve and a hot water valve. Both the cold water valve and also the hot water valve can be opened and/or closed by means of a control device as a function of an operating program. The hot water required by the dishwasher can in this way be taken from a hot water supply line, the water of which is heated by a domestic heating system.

It is beyond question that the use of hot water from a domestic heating system can result in a saving of electrical energy, since, in this case, the energy requirement of an electrical heating element of the dishwasher can be reduced. Against the background of generally rising operating costs of domestic heating systems, the additional costs for the operation of the domestic heating system which are generated as a result of the removal of hot water from the domestic hot water supply line in many instances exceed the electricity costs which have been saved.

BRIEF SUMMARY OF THE INVENTION

The object of the present invention is to provide a dishwasher which incurs lower energy costs during operation.

The object is achieved in a dishwasher of the type cited in the introduction in that the hot water intake is provided to receive hot water from an external hot water supply, which is at least partially fed especially by a thermal solar system, with the at least one wash program providing at least one program step for washing dishes using hot water from the hot water supply and a program step for washing dishes using cold water from the cold water supply.

This bithermal water connection with a controllable hot water connection and at the same time a controllable cold water connection can reduce the total energy outlay for operating the dishwasher. At the same time, this bithermal water connection allows for an improved flexibility with the wash program control of the respectively selected dishwasher program of the inventive dishwasher. The intake of solely hot water, solely cold water or any mixture of hot water and cold water can be selected for each program step of the selected dishwasher program.

With the inventive bithermal water connection device, in accordance with an advantageous development of the invention, both a hot water connection, which is controllable in respect of the intake, in particular by means of a valve, and also simultaneously a cold water connection, which is controllable in respect of the intake, in particular by means of a valve, are provided, as a result of which a flexible wash program control is enabled, which, depending on the requirement, allows for a free selection of the intake of hot water or cold water or the mixture of hot water and cold water. It is therefore possible for instance to change from a hot water intake during the final rinse step of a selected dishwasher program after conclusion of the final rinse step to the cold water intake, in particular to prepare for the concluding drying step of the selected dishwasher program, in order to fill a container with cold water, said container being provided on the side wall of the wash tub of said dishwasher as a heat exchanger for generating a condensation surface. By contrast, a dishwasher, for which only a hot water connection is provided, would have the particular disadvantage that a container, which is provided on the side wall of the wash tub of said dishwasher as a heat exchanger for generating a condensation surface, can no longer bring about the desired condensation effect during the drying step of a selected dishwasher program due to being filled with hot water, as it would if it were filled with cold water. This would therefore result in a loss of drying power.

Furthermore, the inventive bithermal water connection advantageously allows for a change or switch from the hot water connection to the cold water connection for instance, in order in particular to be able to perform a regeneration step and/or rinse step for the ion exchanger of the inventive dishwasher using cold water. As a result, hot water from the hot water supply and thus energy can be saved.

Within the scope of the invention, the term "controllable" also means that the intake from the hot water connection and the cold water connection can be regulated by means of valves, in particular Aquastop valves. In particular, the valve on the hot water connection on the intake side and the valve on the cold water connection on the intake side can be brought into an open state and a closed state by means of the program control device of the dishwasher in each instance.

A thermal solar system is a technical system for converting solar energy to useable thermal energy. Here thermal solar systems usually provide hot water in a temperature range of for instance 40° C. to 70° C., which renders possible the direct use of the hot water for heating buildings and also as process water. Thermal solar systems usually include a plurality of solar collectors, which comprise an absorber surface, which is heated by the electromagnetic solar radiation. The heat can be transported from there to a heat exchanger by means of a fluid, said heat exchanger generating the hot water.

With favorable conditions, the domestic hot water requirement can be covered with collector surfaces of a few square meters even in a temperate climate. The production costs for the thermal energy obtained are extremely low here. However the output of the solar collectors is not sufficient in many locations, for instance in central Europe, in the winter months, in poor periods of summer weather or in the event of high hot water demand. Solar systems therefore comprise, in many instances, a conventional auxiliary heater, for instance a gas or oil heater, in order to also have sufficient hot water available in such a situation. If however the auxiliary heater has to be used, production costs generally increase for the hot water provided.

Aside from or in addition to a domestic solar system, a cost-effective hot water supply can be made available, if necessary, by a modern condensing heating system, for instance pellet stove heating, wood chip heating or log heating, a combined heat and power system, pump-assisted geothermal heating, pump-assisted air source heating, a teleheating system or a local heating system, individually or in any combination etc. In particular, the linking of a pellet stove to a thermal solar system may be advantageous for instance in terms of energy.

The inventive dishwasher enables the efficient use of hot water which is cost-effectively generated by means of a hot water supply system, in particular solar system. To this end, at least one wash program is provided, which provides at least one program step for washing dishes using hot water from the hot water supply system and a program step for washing dishes using cold water from the cold water supply system. In this way it is possible to ensure that the quantity of hot water taken from the hot water supply system, in particular solar system, during the running of a wash cycle is restricted to a minimum amount. In situations in which the domestic hot water requirement cannot be covered completely, in particular by solar heating, from the currently existing hot water supply system, the costs of the auxiliary heater for the hot water supply system can be reduced. This ensures that the saving of electrical energy for the operation of an electrical heating device of the dishwasher and the additional outlay for providing an adequate quantity of hot water by means of the external auxiliary heater are favorably proportional. An inventive dishwasher can therefore be operated more efficiently than a dishwasher which uses hot water or cold water supplied exclusively in each instance to clean the dishes.

According to a preferred development of the invention, the wash program provides a cleaning step for washing dishes, in which dishes are subjected to hot water from the hot water supply. A cleaning step is used to thoroughly clean the dishes. To this end it is necessary to subject the dishes to water which has a comparatively high temperature so as to achieve a good thermal cleaning effect. In addition, detergent is generally added to the water, the chemical cleaning effect of which is at its best at a high temperature. A temperature of approximately 50° C. to 70° C. is therefore usually provided for a cleaning step. With the use of hot water, e.g. from the solar system for the cleaning effect, it is therefore ensured that the thermal energy taken from the solar system is used expediently. A significant saving of electrical energy can be achieved here, since the hot water from the solar system need not, in many instances, and only to a minimal degree in other instances, be reheated by the electrical heating device in the dishwasher in order to reach the necessary temperature.

According to an advantageous development of the invention, the wash program provides a final rinse step for washing dishes, wherein dishes are subjected to hot water from the hot water supply. A final rinse step is used in particular to prevent spotting on the dishes, which may result from dissolved substances in the water, for instance salt and limescale. To this end, rinse-aid is added to the water during the final rinse step. A further object of the final rinse step is to prepare for a subsequent drying step. Therefore the dishes are heated during the final rinse step, using particularly hot water, which has a temperature of 60° C. to 75° C. for instance. In the concluding drying step, water drops adhering to the hot dishes evaporate and are deposited on the interior of the wash tub on account of the lower temperature prevailing there. With the use of hot water, e.g. from the solar system for the final rinse step, it is therefore likewise ensured that the thermal energy taken from the solar system is used expediently. A significant saving of electrical energy can also be achieved here since the hot water from the solar system need not, in many instances, and only to a minimum degree in other instances, be reheated by the electrical heating device in the dishwasher in order to reach the temperature required for the final rinse step.

According to a preferred development of the invention, the wash program provides for a pre-rinse step for washing dishes, wherein dishes are subjected to cold water from the cold water supply in order to prepare for a cleaning step. The pre-rinse step is used to remove coarser dirt from dishes so as to prepare for a cleaning step. The removal of this coarser dirt essentially takes place mechanically, so that in many instances during the pre-rinse step it is possible to dispense with detergents and similarly with high temperatures. Cold water from the cold water supply can therefore be used without any problem, without this having to be heated using a significant amount of electrical energy. At the same time, the heat quantity taken from the hot water supply can therefore be reduced without the cleaning result being noticeably impaired.

According to an advantageous development of the invention, the wash program provides for an intermediate rinse step for washing dishes, wherein dishes are subjected to cold water from the cold water supply in order to remove detergent from the dishes following a cleaning step. An intermediate rinse step is used in particular to remove detergent residues, which adhere to the dishes following a cleaning step. Higher temperatures are generally not needed here either, so that cold water from the cold water supply can also be used in the intermediate rinse step without any problem, without this having to be heated with a higher electrical energy input. At the same time, the heat quantity taken from the hot water supply can therefore be further reduced without the cleaning result being impaired According to a preferred development of the invention, provision is made for the hot water intake to include a hot water valve and the cold water intake to include a cold water valve, whereby the hot water valve and the cold water valve can be controlled independently of one another by means of the program control device. It is herewith easily possible to receive hot water from the hot water supply and cold water from the cold water supply as provided for by means of the wash program in each instance. In particular, it is possible to dispense with an external device for controlling the receiving of water.

According to an expedient development of the invention, provision is made for the hot water valve to be arranged at an upstream end of a hot water hose and be embodied such that it can be fastened to a connection piece of the external hot water supply, and/or for the cold water valve to be arranged at an upstream end of a cold water hose and be embodied such that it can be fastened to a connection piece of the external cold water supply. The hot water valve and/or the cold water valve can to this end comprise connecting threads for instance, which correspond to the threads of water taps normally used for domestic purposes. Valves of this type are also known as Aquastop valves.

The arrangement of the hot water valve and/or of the cold water valve at the upstream end of the water intake device is advantageous in that even in the event of damage, practically no leakage water can escape from the dishwasher if the valves are closed. If the valves are embodied such that they close if they are not activated, an escape of leakage water from a switched-off dishwasher is prevented in practically all instances. In order also to prevent an escape of leakage water from a switched-on dishwasher, the program control device can be assigned a leakage water sensor for detecting leakage water, so that the program control device can close the valves if leakage water occurs during the operation of the dishwasher.

According to a preferred development of the invention, provision is made for a downstream end of the hot water hose and a downstream end of the cold water hose to be connected in a fluid-conducting fashion to an intake hose by way of a connecting piece, said intake hose being connected to a connection piece of the dishwasher which is fixed to the housing. An embodiment of the water intake device of this type is structurally simple and in many instances significantly shortens the hose length which is needed overall, particularly if the connection points of the external hot water supply and the external cold water supply are further away from the installation location of the dishwasher, since, in this case, it is possible to dispense with two longer parallel hoses.

In particular, in accordance with a first advantageous variant, the connecting piece, in particular Y-shaped connecting piece, can be provided outside the dishwasher in a freely suspended fashion on the hot water hose and the cold water hose and can be connected to the water intake device of the dishwasher on the appliance side by way of an external intake hose. This may then be expedient for instance if the connecting piece is only subsequently mounted on the dishwasher as an extra part.

According to a second advantageous variant, it may however be expedient in particular for the connecting piece, in particular Y-shaped connecting piece, to be attached to the appliance-side water intake device of the dishwasher on the appliance side, in particular internally. Because the water intake device of the inventive dishwasher, in particular domestic dishwasher, can be equipped on the appliance side in particular with a connecting piece, preferably Y-shaped connecting piece, preferably already fully prepared by the manufacturer, the connection of the dishwasher to an external hot water supply and to an external cold water supply is facilitated and/or simplified for an operator, since it is not necessary to install the connecting piece as a loose, cumbersome component part outside the dishwasher in the external space between the external hot water supply, the external cold water supply and the dishwasher by means of three long water connection hoses. Since the connecting piece can be attached directly to the water intake device of the dishwasher, it is possible to dispense with a water supply hose that passes out of, i.e. is guided out of the housing of the dishwasher between the water intake device of the dishwasher and the connecting piece. The connecting piece is therefore preferably provided as a piece of equipment on the appliance side. It may in particular form an integrated component in the dishwasher or an add-on piece on the dishwasher. The attachment of the connecting piece on the appliance side enables said connecting piece to be mechanically connected securely, i.e. reliably, to the water intake device. Impermissible strains, in particular impermissibly high tensile loads on the connecting piece, and other impermissible damage to the connecting piece are largely avoided in this way, which may in contrast be associated with a free "head down" suspension of the connecting piece on the water connections, in particular water taps of the external hot water supply and external cold water supply. In particular, two external water supply hoses are advantageously sufficient to connect the hot water intake line section of the connecting piece to the external hot water supply and the cold water intake line section of the connecting piece, in particular Y-shaped connecting piece, to the external cold water supply, i.e. two connection processes are sufficient, which simplifies assembly for an operator and/or fitter. Here in particular, impermissibly high tensile loads or other impermissibly large mechanical strains on these water intake hoses and the water connections, in particular water taps of the external hot water supply and the external cold water supply, to which the water intake hoses are coupled on the upstream side, are largely avoided, which, by contrast, may occur in the case of a freely suspended connecting piece due to the effect of its inherent weight. Furthermore, the storage and packaging of the dishwasher is simplified by dispensing with the connecting piece as a loose, external extra part. Furthermore, the attachment of the connecting piece on the appliance side provides for a type of uniformity, in particular standardization of the assembly and/or manufacture, storage and packaging of dishwashers embodied in this way.

The inventive dishwasher with the connecting piece, in particular Y-shaped connecting piece which is attached externally or on the appliance side, is therefore prepared such that depending on the prevailing water connection conditions, it can be connected solely in each instance to an external hot water supply, an external cold water supply, or to both an external hot water supply and an external cold water supply at the same time.

The invention also relates to method for controlling at least one wash cycle of a dishwasher, in particular domestic dishwasher, by means of at least one wash program of a program control device, with the dishwasher comprising a water intake device having a hot water intake for receiving hot water from an external hot water supply and a cold water intake for receiving cold water from an external cold water supply, which is characterized in that from at least one wash program for washing dishes, at least one program step is run using hot water from the external hot water supply, which is at least partially fed especially by a thermal solar system, and at least one program step is run using cold water from the external cold water supply.

Other developments of the invention are reproduced in the subclaims.

BRIEF DESCRIPTION OF THE DRAWINGS

The invention and its developments are shown in more detail below with the aid of drawings, in which.

DETAILED DESCRIPTION OF EXEMPLARY EMBODIMENTS OF THE PRESENT INVENTION

Figure 1:
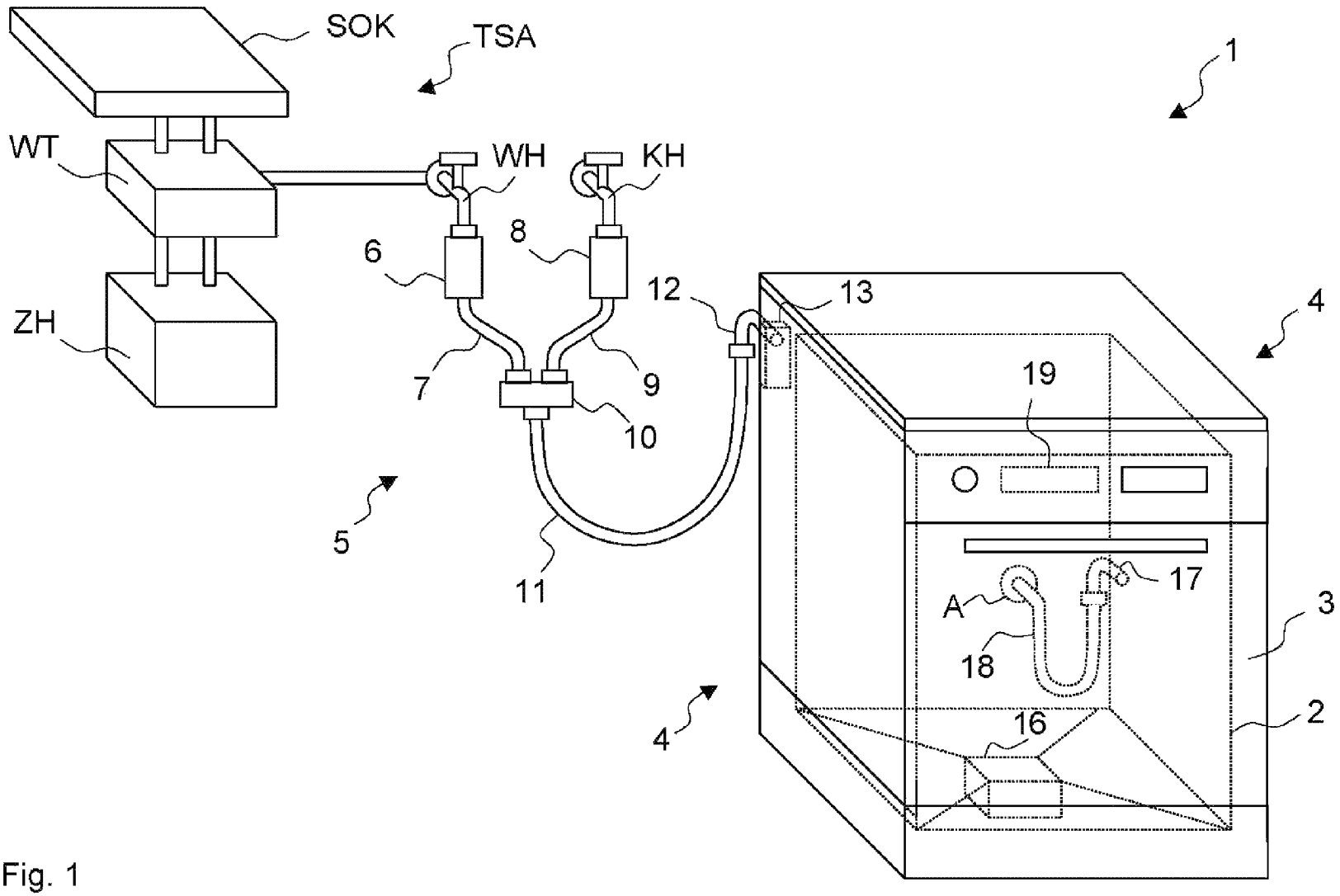
FIG. 1 shows a schematic spatial representation of an exemplary embodiment of an inventive dishwasher.

Corresponding parts are provided with the same reference characters in the subsequent figures. Only those component parts of a dishwasher, which are needed to understand the invention, are provided with reference characters and explained here. It goes without saying that the inventive dishwasher can include further parts and components.

FIG. 1 shows a schematic spatial representation of an exemplary embodiment of an inventive dishwasher 1. This comprises a wash tub 2, which can be closed by a door 3, so that a wash cell is provided for washing dishes. The wash tub 2 is arranged inside a housing 4 of the dishwasher 1, which can have standard dimensions. For instance, the housing 4 can have a width of 45 cm or 60 cm, which allows integration of the dishwasher 1 in a standard row of kitchen units with a corresponding recess.

A water intake device 5 which is shown schematically is arranged on the rear of the dishwasher 1. This comprises a hot water intake 6, 7 and a cold water intake 8, 9, with the hot water intake 6, 7 being provided to receive hot water from an external hot water supply WH and the cold water intake 8, 9 being provided to receive cold water from an external cold water supply KH.

Here the hot water intake 6, 7 includes a controllable hot water valve 6 and the cold water intake 8, 9 a controllable cold water valve 8. The hot water valve 6 and cold water valve 8 are basically designed identically. For instance, both valves 6, 8 can be embodied as magnetic valves. The input sides of the valves 6, 8 are embodied in each instance such that they can be fastened to connection pieces WH, KH of a domestic water supply, for instance to water taps WH, KF. Connection can take place in each instance by means of a screw connection, a snap-on connection or suchlike. Valves 6, 8 of this type are also known under the name Aquastop valve 6, 8. These are advantageously closed, if they are not activated, so that the dishwasher 1 is isolated from the water supply in the switched-off state. In the event of a fault, an escape of leakage water from the switched-off dishwasher 1 can be prevented in this way.

In accordance with regulations in FIG. 1 the input side of the hot water valve 6 is connected to a hot water tap WH and the input side of the cold water valve 8 is connected to a cold water tap KH. The output side of the hot water valve 6 is connected here to a hot water hose 7 and the output side of the cold water valve 8 is connected to a cold water hose 9, with the downstream ends of the hot water hose 7 and of the cold water hose 9 being connected to an input side of a connecting piece 10. This is embodied in particular as a Y-shaped branch. Connected to its output side is a shared intake hose 11 for hot water and cold water which is in turn connected to a connection piece 12 on the housing 4 of the dishwasher 1. It is subsequently possible by means of the water intake device 5 to conduct hot water from an external hot water supply WH and/or cold water from an external cold water supply KH into the inside of the dishwasher 1 in an individually controlled fashion.

The hot water hose 7, the cold water hose 9 and/or the shared intake hose 11 can be embodied as safety hoses with an internal water-conducting pressure hose and an external envelope hose, it being possible to provide a leakage water channel for the discharge of possibly escaping leakage water between pressure hose and envelope hose. Here the connecting piece 10 can be embodied such that the leakage water channels of the hot water hose 7, of the cold water hose 9 and of the shared intake hose 11 are connected to one another so that leakage water, which occurs during operation of the dishwasher 1 in the region of the water intake device 5, is routed into the inside of the dishwasher 1 by way of the connection piece 12 which is fixed to the housing. It can be detected here by a leakage water sensor (not shown), so that corresponding measures, for instance closing the hot water valve 6 and cold water valve 8, can be introduced.

Alternatively to this external arrangement of the, in particular Y-shaped branch-like, connecting piece 10 outside the dishwasher, it may be advantageous if the connecting piece is fixedly coupled or molded on the appliance side, in particular inside the appliance, to the appliance-side connection piece, in particular without an external intake hose. This may in particular also already be prepared in advance by the manufacturer. In this variant the shared intake hose can be omitted. In particular the connection piece 12 together with the Y-shaped connecting piece 12 can be provided in the region of the bottom assembly on or in this.

A free flow course 13 is provided downstream of the connection piece 12 which is fixed to the housing. The free flow course 13 is a so-called pipe interrupter, which is used to prevent the backflow of water from the dishwasher 1, if a low pressure develops in the external water supply as a result of dynamic processes. It in particular prevents already used water, which can contain dirt, detergent and/or cleaning agents, getting back into the water supply on the building side.

The dishwasher 1 also comprises components which are not shown in FIG. 1, which enable hot water and/or cold water to be conducted from the output of the free flow course 13 into the wash tub 2.

In a lower region of the wash tub 2, a sump 16 is provided, in which a circulating pump for circulating water in the wash tub 2 during a wash cycle is expediently provided. Here the circulating pump can comprise a heating device for heating the water in the wash tub 2, for instance a continuous-flow water heater. Similarly a pump for pumping off water, for instance at the end of a wash cycle, can be provided in the sump 16. The different pump functions may however also be realized by a single pump in connection with switchable valves. The sump 16 is generally connected to a waste water connection piece 17 by way of means (not shown) so that water can be pumped out of the wash tub 2 via a waste water hose 18 connected to the waste water connection piece 17 into a waste water device A installed on the building side, for instance a waste water pipe A.

The dishwasher 1 also comprises a program control device 19 for controlling the sequence of a wash program. Different wash programs, which can be selected by an operator, can be stored in the program control device 19. The program control device 19 is arranged inside the door 3 of the wash tub 2, but could however also be arranged at another point in the dishwasher 1.

In FIG. 1, the hot water intake 6, 7 of the dishwasher is connected in the required manner to an external hot water supply WH, which is supplied with hot water by a thermal solar system TSA. The thermal solar system TSA includes a plurality of solar collectors SOK, of which only one is shown for reasons of space. The solar collectors SOK each comprise an absorber surface (not shown), which can be heated by the electromagnetic solar radiation. The heat can be transported from there by means of a fluid to a heat exchanger WT, which generates the hot water for the hot water supply WH.

In order to be able to provide sufficient hot water in situations in which the thermal energy provided by the solar collectors is not sufficient, the solar system has a conventional auxiliary heater ZH, for instance a gas or oil heater, which can likewise supply heat to the heat exchanger WT.

Figure 2:
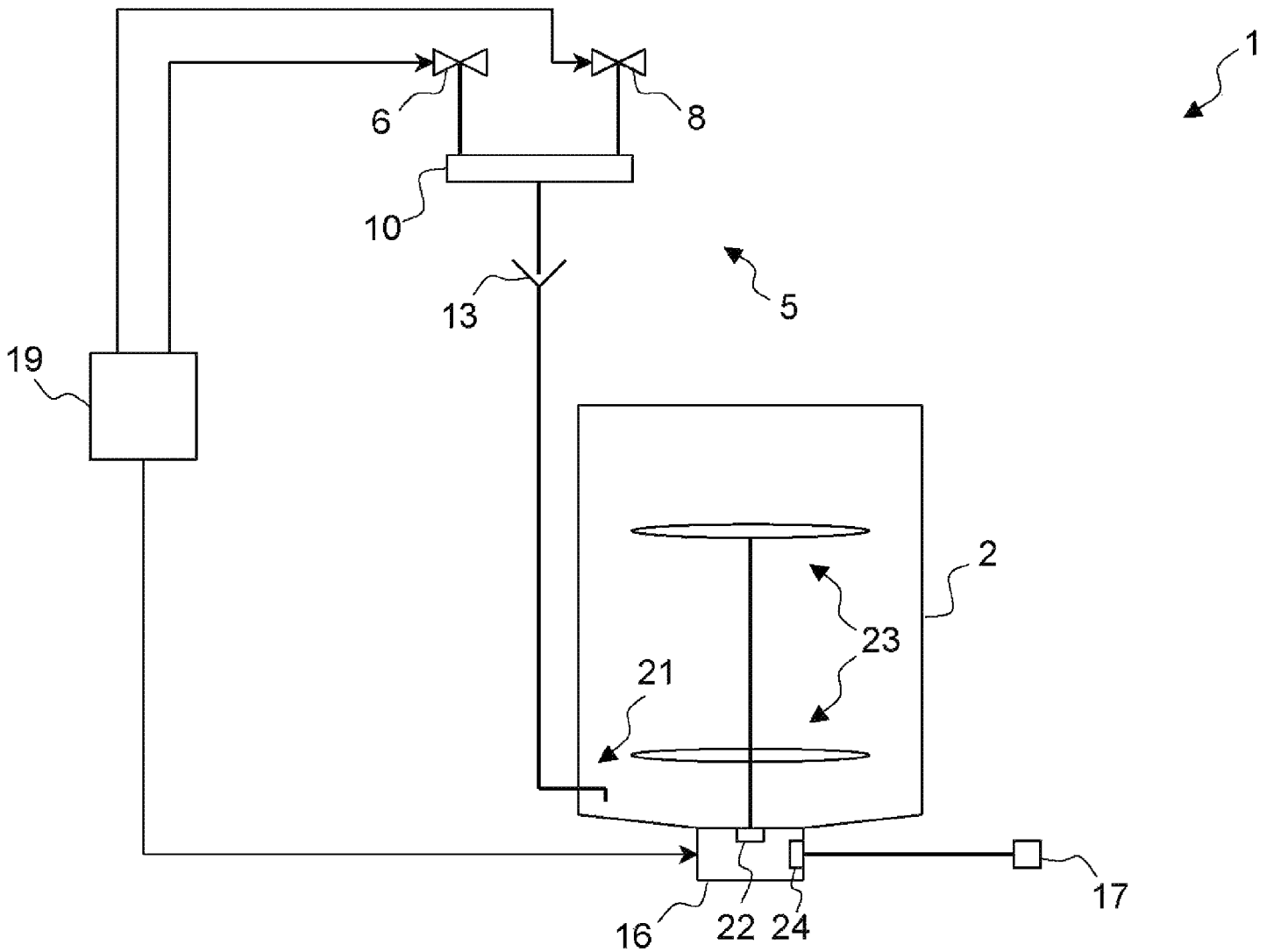
FIG. 2 shows a block diagram of the inventive dishwasher in FIG. 1.

FIG. 2 shows a functional diagram of the dishwasher in FIG. 1. The hot water valve 6 and the cold water valve 8 are each connected to the program control device 19 such that both can be activated individually. It is therefore possible to fill the wash tub 2 of the dishwasher 1 specifically with hot and/or cold water by way of the connecting piece 10, the free flow course 13 and a drain 21.

A circulating pump 22 embodied as a heating pump 22 is arranged in the sump 16 of the wash tub 2, said circulating pump 22 being connected to a spray system 23 which is arranged inside the wash tub 2. It is herewith possible to subject dishes which are arranged in the wash tub 2 to water during a wash cycle so as to clean the same. Furthermore, a drain pump 22 is arranged in the sump which enables water which is no longer needed to be pumped off outwards. In the case of the heating pump 22, both the heating function and also the pump function can be individually controlled by means of the program control device 19. Furthermore the program control device 19 is also connected to the drain pump 24 to control the same.

The filling of the dishwasher 1 with water takes place in the same way as the control of the heating pump 22 and the drain pump 24 as well as further devices (not explained here) in the dishwasher 1 as a function of a wash program, which is stored in the program control device 19. With an inventive dishwasher 1, at least one wash program is provided here, which can be especially selected for efficient use of water heated by solar heating.

Figure 3:
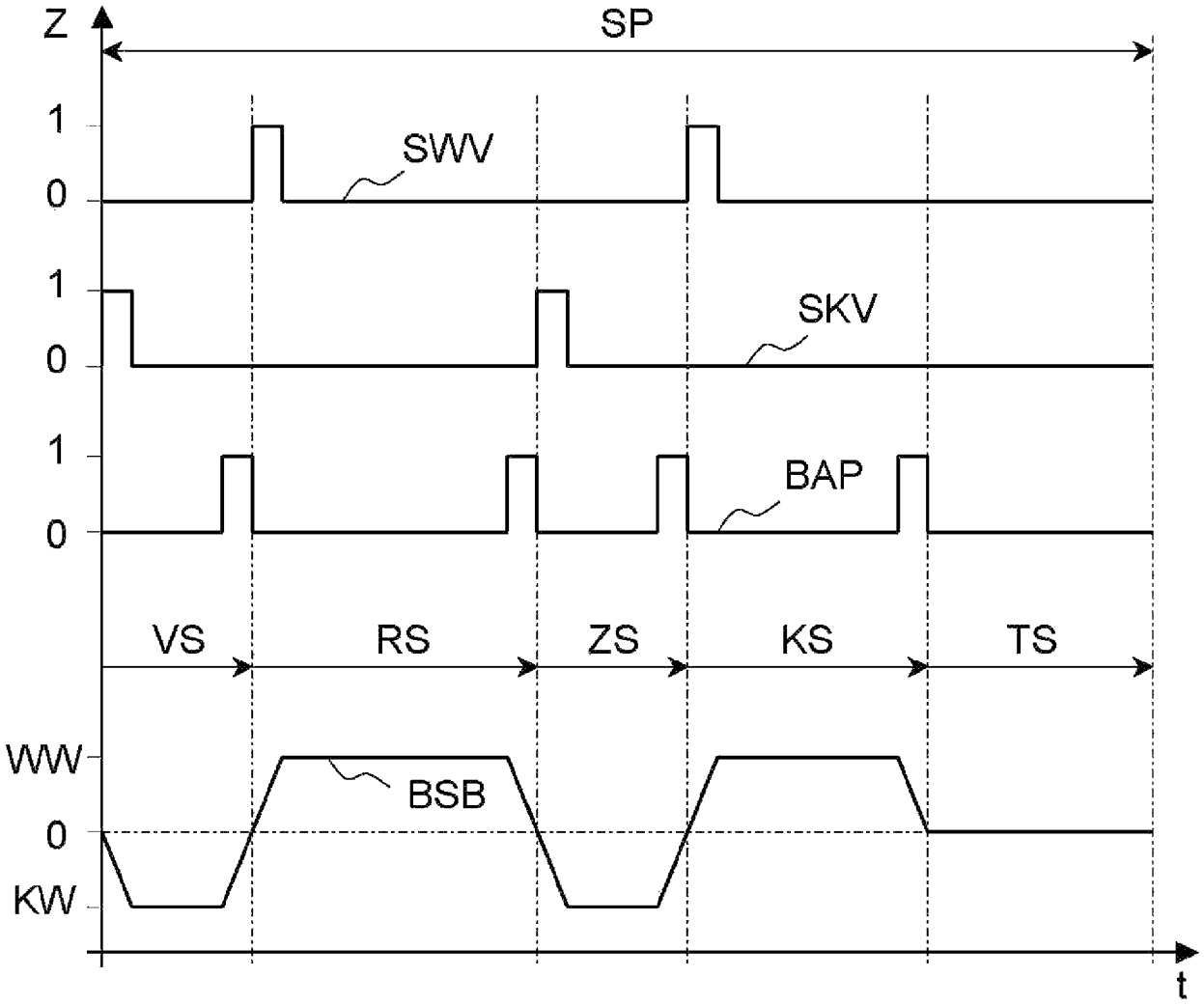
FIG. 3 shows a functional diagram for explaining the function of the inventive dishwasher in FIG. 1.

FIG. 3 shows a functional diagram to explain the function of the inventive dishwasher 1 in FIGS. 1 and 2. To this end the sequence of a wash program SP is shown, which is provided to control a sequence of a wash cycle, when the hot water intake device 6, 7 of the dishwasher 1 is supplied with hot water from a thermal solar system TSA.

FIG. 3 shows the curves SWV, SKV, BAP and BSP on a shared time axis t, which indicate switching and/or operating states of components of the dishwasher 1 on the vertical axis Z.

The curve SWV in this way represents the switching state of the hot water valve 6 of the dishwasher 1. Furthermore, the curve SKV shows the switching state of the cold water valve 8 of the dishwasher 1. The switching state "0" corresponds here in each instance to a closed valve 6, 8, the switching state "1" to an open valve 6, 8. The curve BAP also represents the operating state of the waste water pump 24, with the switch-off state being symbolized by "0" and the switch-on state being symbolized by "1". The curve BSB finally shows the water fill state of the wash tub 2. A wash tub 2 filled with hot water from the hot water supply WH is shown with "WW", a wash tub 2 filled with cold water from the cold water supply KH is shown with "KW" and an empty wash tub 2 is shown by "0".

FIG. 3 shows a wash program SP by way of example, which, in this order, includes a pre-rinse step VS, a cleaning step RS, an intermediate rinse step ZS, a final rinse step KS and a drying step TS. One or several of these steps could be left out in other examples. Examples are also possible in which one or several steps are run repeatedly.

The pre-rinse step VS which is implemented first is used to remove coarser dirt from the dishes so as to prepare for the cleaning step RS. To this end, at the start of the pre-rinse step VS, the cold water valve 8 is opened until the wash tub 2 is filled with an adequate quantity of cold water from the cold water supply KH. This cold water is circulated by means of the heating pump 22 for a predetermined time, generally without switching on its heating device so as to subject the dishes to cold water. The now dirty cold water is then pump off outwards by means of the drain pump 24.

The use of cold water from the cold water supply KH during the pre-rinse step VS is possible without any problem, since the removal of coarser dirt essentially takes place mechanically so that it is possible in many cases to dispense with high temperatures during the pre-rinse step. Reheating by means of the heating pump 22 can therefore be omitted or implemented with a minimal usage of electrical energy. At the same time, the heat quantity taken from the hot water supply WH can be reduced without the cleaning result being noticeably impaired.

The cleaning step RS then implemented is used to thoroughly clean the dishes. To this end, at the start of the cleaning step RS, the hot water valve 8 is opened until the wash tub 2 is filled with an adequate quantity of hot water from the hot water supply WH. The hot water supplied to the wash tub 2 is now circulated for a predetermined time with the aid of the heating pump 22 so as to subject the dishes to hot water. The heating device of the heating pump 22 can be switched on as required as a function of the temperature of the supplied hot water and as a function of the intended wash temperature in the cleaning step RS. To conclude the cleaning step RS, the now dirty hot water is pumped off outwards by means of the drain pump 24.

During the cleaning step RS, it is generally necessary to subject the dishes to water, which has a comparatively high temperature, so as to achieve a good thermal cleaning effect. In addition, detergent is generally added to the water, the chemical cleaning effect of which is at its best at a higher temperature. A temperature of approximately 50° C. to 70° C. is therefore usually provided for a cleaning step RS. With the use of hot water from the thermal solar system TSA for the cleaning step RS, it is therefore ensured that the thermal energy taken from the solar system TSA is used expediently. A significant saving of electrical energy can be achieved here since the hot water from the thermal solar system TSA need not in many instances and only to a minimum degree in other instances, be reheated by the electrical heating pump 22 in the dishwasher 1 in order to reach the necessary temperature.

The now implemented intermediate rinse step ZS for removing detergent from dishes after the cleaning step RS likewise provides for the filling of the wash tub 2 with cold water from the cold water supply KH so as to be able to subject the dishes to cold water. To this end, the cold water valve 8 is firstly opened until the wash tub 2 is filled with a quantity of cold water which is sufficient for the intermediate rinse step ZS. This cold water is circulated for a predetermined time by means of the heating pump 22, in which process it is generally not necessary to switch on its heating device. The now dirty cold water is then pumped off outwards by means of the drain pump 24.

During the intermediate rinse step ZS, higher temperatures are generally not needed, so that cold water from the cold water supply can also be used in the intermediate rinse step ZS without this having to be heated by means of the heating pump 22 with a higher electrical energy input. At the same time, the heat quantity taken from the hot water supply WH is further reduced without the cleaning result being impaired.

In the final rinse step KS which now follows provision is made to subject dishes to hot water from the hot water supply. To this end, the hot water valve 8 is firstly opened again until the wash tub 2 is filled with a quantity of hot water from the hot water supply WH which is sufficient for the final rinse step KS. The hot water supplied to the wash tub 2 is now circulated for a predetermined time with the aid of the heating pump 22, so as to subject the dishes to hot water. Even during the final rinse step KS, the heating device of the heating pump 22 can be switched on as required as a function of the temperature of the supplied hot water and as a function of its intended wash temperature. At the end of the final rinse step KS, the now dirty hot water is pumped off outwards by means of the drain pump 24.

A final rinse step KS is used in particular to prevent spotting on dishes, which may result from dissolved substances in the water, for instance salt and/or limescale. To this end a rinse-aid is added to the water during the final rinse step KS. A further object of the final rinse step KS consists in preparing for a subsequent drying step TS. The dishes are therefore heated during the final rinse step KS using particularly hot water, which has a temperature of 60° C. to 75° C. for instance. As a result, water drops adhering to the hot dishes evaporate in the subsequent drying step TS and are deposited on the inside of the wash tub 2 on account of the lower temperature prevailing there. With the use of hot water from the solar system TSA for the final rinse step KS, it is likewise ensured that the thermal energy taken from the solar system TSA is used expediently. A significant saving of electrical energy can also be achieved here since the hot water from the solar system TSA need not in many instances, and only to a minimal degree in others instances, be reheated by the electrical heating device 22 in the dishwasher 1 in order to achieve the temperature needed for the final rinse step KS.

During the concluding drying step TS, there is no provision to fill the wash tub 2 with water.

In an exemplary embodiment of an inventive dishwasher, two water connections are provided, which can be activated separately using an Aquastop valve in each instance. One water connection is provided for hot cost-effective solar water, the other water connection for cold water from the mains network. Both water connections can be individually selected by way of a controller of the dishwasher. Downstream of the two valves, the water then flows via a Y-shaped piece in a hose to a water intake system of the dishwasher. A bithermal water connection is therefore provided.

The dishwasher can now use hot water from the hot water solar system and/or cold water from the mains network individually.

Advantages result from the partial use of cost-effectively heated solar water and from the saving of energy, which is possible due to the specific use of different types of water in the respective program sections. The predetermined performance data (washing and drying performance) of the dishwasher can be achieved efficiently in this way.

In general terms the program control device of the dishwasher features:

a first mode of operation, wherein at least one wash program can be called up, which, in the case of at least one wash program step, provides for a use of hot water from the external hot water supply, a second mode of operation, wherein at least one wash program can be called up, which, in the case of at least one wash program step, exclusively provides for a use of cold water from the external cold water supply, and/or a third mode of operation, wherein at least one wash program can be called up, which, in the case of at least one wash program step, provides for the mixing of hot water from the external hot water supply with cold water from the external cold water supply.

To this end, provision is made in particular for the connecting piece, preferably Y-shaped connecting piece. It may be provided in particular fixed to the appliance, preferably internally in the appliance, or externally, i.e. outside the dishwasher. The respective intake of hot water and/or cold water can be controlled in each instance by means of a controllable valve in both intake-side feed line branches of the Y-shaped connecting piece or in the intake hoses connected to these on the intake side with the aid of the program control device. A bithermal water connection is provided in this way by the connecting piece.

Instead of the Y-shaped connecting piece, a differently shaped connecting piece may also be expedient, which likewise allows for a branching of two separate water intakes, in particular a hot water intake and a cold water intake, to a shared drain piece.

In particular, it may be expedient if necessary, instead of or in addition to the thermal solar system, for the provision of a cost-effective domestic hot water supply, to use a modern condensing heating system, for instance pellet stove heating, wood chip heating or log heating, a combined heat and power system, pump-assisted geothermal heating, pump-assisted air source heating, a teleheating system or a local heating system, individually or in any combination etc. In particular, the linking of a pellet stove to a thermal solar system may be advantageous for instance in terms of energy. Other hot water supply systems, which manage without or with only relatively low primary energy requirements in respect of fossil fuel media and/or only use largely $CO_2$ neutral energy media, in particular are efficient in terms of energy. The embodiments explained for a solar thermal hot water generation system apply similarly, in the presence of another hot water supply system, in respect of the design and control of the inventive dishwasher.

LIST OF REFERENCE CHARACTERS

1 Dishwasher
2 Wash tub
3 Door
4 Housing
5 Water intake device
6 Hot water valve
7 Hot water hose
8 Cold water valve
9 Cold water hose
10 Connecting piece
11 Intake hose
12 Connection piece fixed to the housing
13 Free flow course
16 Sump
17 Waste water connection piece
18 Waste water hose
19 Program control device
21 Drain
22 Circulating pump with continuous-flow water heater
23 Spray device
24 Drain pump, waste water pump
A Waste water pipe
KH Cold water supply, cold water tap
WH Hot water supply, hot water tap
TSA Thermal solar system
SOK Solar collector
WT Heat exchanger
ZH Auxiliary heating
SWV Switching state of the hot water valve
SKV Switching state of the cold water valve
BAP Operating state waste water pump
BSB Fill state of the wash tub
SP Wash program
VS Pre-rinse step
RS Cleaning step
ZS Intermediate rinse step
KS Final rinse step
TS Drying step

The invention claimed is:

1. A dishwasher, comprising:

a water intake device having a hot water intake which receives hot water from an external hot water supply fed, at least partially, by a thermal solar system;

a cold water intake which receives cold water from an external cold water supply; and a program control device in which at least one wash program for controlling a wash cycle for cleaning dishes is stored, wherein the program control device is programmed specifically to control the hot water intake fed, at least partially, by the thermal solar system and the cold water intake to perform the at least one wash program, wherein the least one wash program includes:

a detergent cleaning program step for washing the dishes;

a final rinse step for rinsing the dishes; and one or more other program steps, wherein the program control device is programmed to:

control the hot water intake and the cold water intake to feed only the hot water during the detergent cleaning program step and the final rinse step, and to prevent the cold water from being fed during the detergent cleaning program step and the final rinse step, control the hot water intake and the cold water intake to prevent the hot water from being fed during the one or more other program steps of the wash program, and to feed only the cold water during the one or more other program steps of the wash program, control the hot water intake and the cold water intake to perform the entire detergent cleaning program step using solely hot water from the hot water supply fed at least partially from the thermal solar system, and control the hot water intake and the cold water intake to perform the entire final rinse step using solely hot water from the hot water supply fed at least partially from the thermal solar system.

2. The dishwasher of claim 1, constructed in the form of a domestic dishwasher.

3. The dishwasher of claim 1, wherein the one or more other program steps of the wash program includes a pre-rinse step for washing dishes, with the dishes being subjected solely to the cold water from the cold water supply to prepare for the detergent cleaning program step.

4. The dishwasher of claim 1, wherein the one or more other program steps of the wash program includes an intermediate rinse step for washing dishes, with the dishes being subjected solely to the cold water from the cold water supply to remove detergent from the dishes following the detergent cleaning program step.

5. The dishwasher of claim 1, wherein the hot water intake comprises a hot water valve, and the cold water intake comprises a cold water valve, said program control device being programmed to control the hot water valve and the cold water valve independently of one another.

6. The dishwasher of claim 5, wherein the hot water valve is arranged at an upstream end of a hot water hose and configured such that the hot water valve is securable to a connection piece of the external hot water supply, and/or that the cold water valve is arranged at an upstream end of a cold water hose and configured such that the cold water valve is securable to a connection piece of the external cold water supply.

7. The dishwasher of claim 6, further comprising a connecting piece, wherein a downstream end of the hot water hose and a downstream end of the cold water hose are connected in a fluid-conducting fashion to the connecting piece.

8. The dishwasher of claim 7, wherein the connecting piece has a Y-shaped configuration.

9. The dishwasher of claim 7, wherein the connecting piece is provided outside the dishwasher in a freely suspended fashion on the hot water hose and the cold water hose, said connecting piece being connected to the water intake device on an appliance side by way of an external intake hose.

10. The dishwasher of claim 7, wherein the connecting piece is attached to the water intake device on an appliance side.

11. The dishwasher of claim 7, wherein the connecting piece is attached to the water intake device internally on an appliance side.

12. The dishwasher of claim 7, further comprising a wash tub, said connecting piece being provided on the wash tub.

13. The dishwasher of claim 7, further comprising a wash tub, said connecting piece being fixed to the wash tub.

14. The dishwasher of claim 7, further comprising a bottom assembly, said connecting piece being provided on or in the bottom assembly.

15. The dishwasher of claim 7, further comprising a bottom assembly, said connecting piece being fixed to or in the bottom assembly.

16. The dishwasher of claim 1, wherein the program control device is programmed to provide, prior to the detergent cleaning program step, a pre-rinse step configured to subject the dishes in a wash tub of the dishwasher to cold water followed by a pre-rinse drain pump step configured to remove the cold water from the wash tub, and wherein the program control device controls the cold water intake and the hot water intake such that, at a start of the detergent cleaning program step following the pre-rinse drain pump step, the cold water intake is closed and the hot water intake is open.

17. The dishwasher of claim 1, wherein the program control device is programmed to provide, prior to the final rinse step, an intermediate rinse step configured to subject the dishes in a wash tub of the dishwasher to cold water followed by an intermediate rinse drain pump step configured to remove the cold water from the wash tub, and wherein the program control device controls the cold water intake and the hot water intake such that, at a start of the final rinse step following the intermediate rinse drain pump step, the cold water intake is closed and the hot water intake is open.

18. A method for controlling at least one wash cycle of a dishwasher, wherein the dishwasher comprises a water intake device having a hot water intake which receives hot water from an external water supply fed, at least partially, by a thermal solar system, and wherein the dishwasher comprises a cold water intake which receives cold water from an external cold water supply;

wherein the method comprises:

executing a wash program of a program control device for washing dishes, wherein the wash program includes:

a detergent cleaning program step for washing the dishes;

a final rinse step for rinsing the dishes; and one or more other program steps, wherein the executing of the wash program includes:

controlling, by the program control device, the hot water intake and the cold water intake to feed only the hot water during the detergent cleaning program step and the final rinse step, and to prevent the cold water from being fed during the detergent cleaning program step and the final rinse step, controlling, by the program control device, the hot water intake and the cold water intake to prevent the hot water from being fed during the one or more other program steps of the wash program, and to feed only the cold water during the one or more other program steps of the wash program, controlling, by the program control device, the hot water intake and the cold water intake to perform the entire detergent cleaning program step using solely hot water from the hot water supply fed at least partially form the thermal solar system, and controlling, by the program control device, the hot water intake and the cold water intake to perform the entire final rinse step using solely hot water from the hot water supply fed at least partially from the thermal solar system.

19. The method of claim 18 for controlling at least one wash cycle of a domestic dishwasher.

20. The method of claim 18, wherein the one or more other program steps includes a pre-rinse program step using solely the cold water from the cold water supply, wherein the detergent cleaning program step is being performed after the pre-rinse program step.

21. The method of claim 18, wherein the one or more other program steps includes a rinse program step using solely the cold water from the cold water supply, and wherein the final rinse program step is performed after the rinse program step.

22. The method of claim 18, wherein the wash program includes, prior to the detergent cleaning program step, performing a pre-rinse step subjecting the dishes in a wash tub of the dishwasher to the cold water followed by a pre-rinse drain pump step that removes the cold water from the wash tub, and wherein the cold water intake is closed and the hot water intake is open prior to commencing the detergent cleaning program step which follows the pre-rinse drain pump step.

23. The method of claim 21, wherein, following the rinse program step and prior to the final rinse program step, the wash program includes a rinse drain pump step for removing the cold water from a wash tub of the dishwasher, and wherein the cold water intake is closed and the hot water intake is open prior to commencing the final rinse program step which follows the rinse drain pump step.

24. A dishwasher, comprising a water intake device having a hot water intake which receives hot water form an external hot water supply fed, at least partially, by a thermal solar system;

a cold water intake which receives cold water from an external cold water supply; and a program control device in which at least one wash program for controlling a wash cycle for cleaning dishes is stored, wherein the program control device is programmed specifically to control the hot water intake fed, at least partially, by the thermal solar system and the cold water intake to perform the at least one wash program, wherein the at least one wash program includes:

a pre-rinse program step;

a detergent cleaning program step following the pre-rinse program step;

a rinse program step following the detergent cleaning program step;

a final rinse step following the rinse program step; and a drying step following the final rinse step, wherein the program control device is programmed to:

control the hot water intake and the cold water intake to feed the hot water during the detergent cleaning program step and the final rinse step, and to prevent the cold water from being fed during the detergent cleaning program step and the final rinse step, control the hot water intake and the cold water intake to prevent the hot water from being fed during the pre-rinse program step and the rinse program step, and to feed the cold water during the pre-rinse program step and the rinse program step, control the hot water intake and the cold water intake to perform the entire pre-rinse program step using solely the cold water from the cold water supply, control the hot water intake and the cold water intake to perform the entire detergent cleaning program step using solely hot water from the hot water supply fed at least partially from the thermal solar system, control the hot water intake and the cold water intake to perform the entire rinse program step using solely the cold water from the cold water supply, and control the hot water intake and the cold water intake to perform the entire final rinse step using solely hot water from the hot water supply fed at least partially from the thermal solar system.

* * * * *